United States Patent [19]

Daniels

[11] 4,408,689

[45] Oct. 11, 1983

[54] FLOOR MERCHANDISE DISPLAY CONTAINER

[75] Inventor: Joseph C. Daniels, Kingston Springs, Tenn.

[73] Assignee: State Industries, Inc., Ashland City, Tenn.

[21] Appl. No.: 357,280

[22] Filed: Mar. 11, 1982

[51] Int. Cl.[3] ..... B65D 5/50

[52] U.S. Cl. ..... 206/45.17; 206/320; 206/621

[58] Field of Search ..... 206/44 R, 44 B, 45.17, 206/320, 621; 211/181

[56] References Cited

U.S. PATENT DOCUMENTS

| | | | |
|---|---|---|---|
| 1,666,294 | 4/1928 | Downes-Martin | 206/45.17 |
| 2,324,436 | 7/1943 | Snyder | 206/45.17 |
| 2,556,638 | 6/1951 | Wickersham | 206/45.17 |
| 2,790,543 | 4/1957 | Toensmeier | 206/44 R |
| 2,964,169 | 12/1960 | Brachman | 206/44 R |
| 3,186,557 | 6/1965 | Wise | 206/44 R |
| 3,961,706 | 6/1976 | Roccaforte et al. | 206/44 R |

*Primary Examiner*—Joseph Man-fu Moy

*Attorney, Agent, or Firm*—Michael, Best & Friedrich

[57] ABSTRACT

A package including a plurality of side panels and a plurality of end flaps to enclose the ends of the package around floor display merchandise. The package includes indicating means which indicate to cut two adjoining panels across their width near one end of the panels and then along the two panels' adjoining edge to near the other end of the panels. The package also includes bending means extending diagonally across the width of the two adjoining panels. The bending means intersect at the panels' adjoining edge. When the panels are cut, they can be bent along the bending means without damaging the structural integrity of the panels. With the panels bent open, a portion of the interior of the panels, as well as the merchandise inside is exposed to view. The package also include a clip which is used to secure the bent panels in their open position.

6 Claims, 6 Drawing Figures

FLOOR MERCHANDISE DISPLAY CONTAINER

BACKGROUND OF THE INVENTION

This invention relates to packages used for containing, shipping and exhibiting floor display merchandise, and more particularly, to packages which can be used for such purposes and for shipping the merchandise to the final consumer.

Floor display merchandise, such a consumer appliance, go through a distribution cycle which involves the handling, viewing, and reshipping of the merchandise by many individuals. The appliance is usually shipped in a heavy corrugated package which bears exterior graphics of an industrial nature to allow for proper handling and conveying of the appliance. After the merchandise is received at the retail outlet the shipping package is removed so the appliance can be put on display for viewing prior to purchase. Floor sales personnel are instructed how to prepare the merchandise to be put on the floor and how to arrange sales materials needed to sell the product.

As the merchandise is viewed by potential customers, it is frequently scratched or dented, thereby significantly reducing the merchandise's selling value. When the product is finally sold, it must be repackaged in order to be delivered to the consumer.

SUMMARY OF THE INVENTION

One of the principal objects of this invention is to provide a package for containing and shipping floor display merchandise which is able to bear exterior graphics to allow for proper distribution of the appliance through the distribution cycle, as well as being capable of being used as a point of purchase sales display.

Another of the principal objects of this invention is to provide for a package for containing, shipping and exhibiting floor display merchandise where the package is receivable to provide protection for the shipping of the merchandise from the retail outlet to the consumer.

For the achievement of the above and other objectives, this invention provides a package including a plurality of side panels and a plurality of end flaps to enclose the ends of the package around the floor display merchandise. The package includes indicating means which indicate to cut two adjoining panels across their width near one end of the panels and then along the two panels adjoining edge to near the other end of the panels. The package also includes bending means extending diagonally across the width of the two adjoining panels. The bending means intersect at the two panels' adjoining edge. When the panels are cut, they can be bent along the bending means without damaging the structural integrity of the panels. With the panels bent open, a portion of the interior of the panels as well as the merchandise inside is exposed to view. This invention also provides for a clip which can be used to secure the bent panels in their open position.

DESCRIPTION OF THE PREFERRED EMBODIMENT

Figure 1:
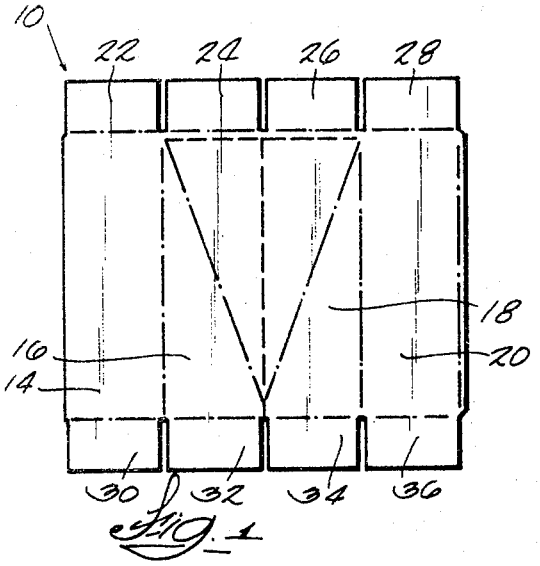
FIG. 1 is a view of an unassembled package.
Figure 2:
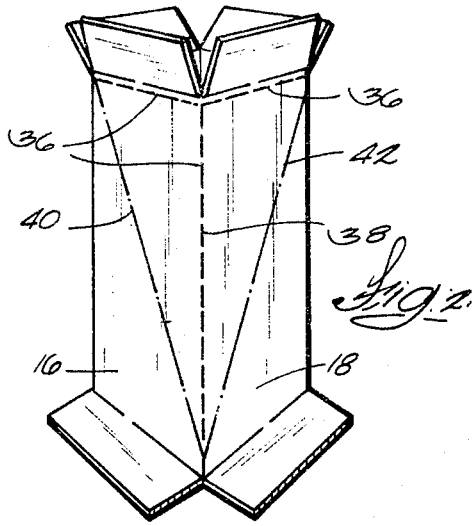
FIG. 2 is a view of an assembled package prior to receiving some floor display merchandise.

With particular reference to the drawings, wherein one embodiment of this invention is described, FIG. 1 shows an unassembled package or box 10 typically used for the shipping of floor display merchandise, such as water heaters 12. The package 10 is comprised of four panels 14, 16, 18 and 20 with each panel having a flap on each of its ends 22 through 30. When assembled, all of the package's panels are connected to one another along each of their adjoining edges.

Protective end pads 32 and 34 (not shown) are placed on each end of the floor display merchandise 12 in order to protect the ends of the merchandise during shipping. The pads also give structural reinforcement to the package. These protective pads fit on the inside of the package, and the flaps on the ends of the panels then fold over the protective pads before the flaps are sealed.

Included with the package are indicating means for indicating how two adjoining panels 16 and 18 of the package should be cut in order to allow the merchandise to be displayed on the retail outlet's floor. The indicating means are either instructions which come along with the package or are lines, pull tapes or score marks 36 on the package, as shown in FIG. 1. The indicating means 36 indicate two adjoining panels 16 and 18 should be cut across their width near one end of the pacakge, preferable at or near the base of the top protective pad 32, and then along their adjoining edge 38 to point near the other end of the package, preferable above the top of the bottom protective pad 34.

On the package 10 are diagonal bending means 40 and 42 which extend across the width of the two adjoining panels 16 and 18 which are to be cut. The bending means 40 and 42 run from the ends of the cuts near the outside edges of the two adjoining panels 16 and 18 near the top of the package to near the bottom of the package where the two bending means then intersect at the end of the cut along the adjoining edge of the panels. The bending means consist of score marks or a series of perforations. The bending means permit the package's side panels 16 and 18 to be bent for purposes of displaying the merchandise inside the package. The bending means also protect the panels from being structurally damaged when the panels are bent so the package can be resealed to permit the product to be shipped to the consumer in the same container.

Marketing indicia 42, such as energy efficiency, price or similar information about the merchandise, is printed on the inside surfaces 44 and 46 of the two adjoining panels 16 and 18 so that when the panels are cut and bent and in an open position, this marketing information 42 can be viewed by consumers at the same time the merchandise is being viewed.

Figure 3:
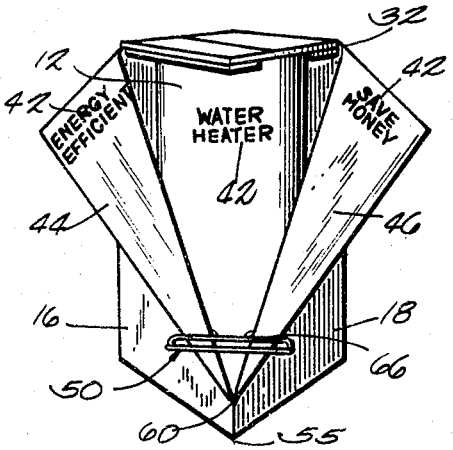
FIG. 3 is a perspective view of a package with a portion of the interior surface of the panels and the floor display merchandise exposed to view.
Figure 4:
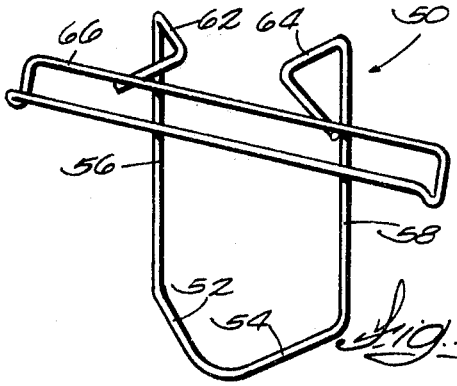
FIG. 4 is a perspective view of a clip.
Figure 5:
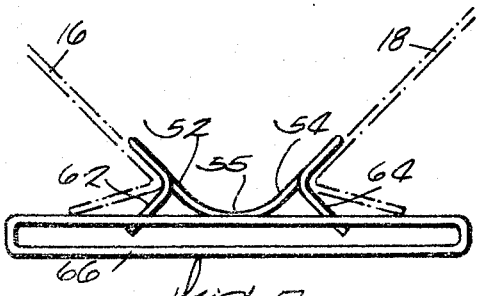
FIG. 5 is a top view of a clip.
Figure 6:
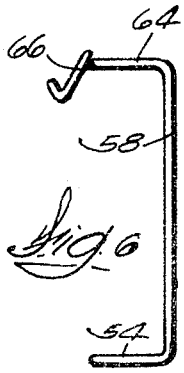
FIG. 6 is a side view of a clip.

In order to hold the panels in their open position, this invention includes a clip 50 which holds the bent panels 16 and 18 as shown in FIG. 3. The clip 50 includes a bent portion having two arm portions 52 and 54 which fit into the package on the inside of the bottom corner 55 of the package formed by the two adjoining panels 16 and 18 (see FIG. 5). Extending perpendicularly from these two arm portions 52 and 54 at points equally spaced and opposite from one another on the arms are two straight portions 56 and 58. The straight portions reach from inside the package to above where the two bending means intersect 60. Exending perpendicularly from each of the straight portions 56 and 58 in the same direction but parallel to the arm portions 52 and 54 are means for holding the panels so the interior surfaces 44 and 46 of the panels can be viewed. Said holding means include bent sections 62 and 64 which fit around the bent corners of the flaps of the panels 16 and 18 and a straight section 66 to then hold the flaps.

The clip is made of metal, plastic or any other rigid material.

It is to be understood that the invention is not confined to the particular construction and arrangement of parts herein illustrated and described, but embraces all such modified forms thereof that come within the scope of the following claims:

I claim:

1. A package for containing, shipping and exhibiting floor display merchandise, comprising:

a plurality of adjoining side panels with ends and interior surfaces, a plurality of end flaps on said ends of said panels, indicating means which indicate to cut two to said panels across their width near one end of said panels and then along said two panels adjoining edge to near the other end of said panels in order to permit said two panels to be bent so a portion of said interior surfaces of said panels can be viewed, and diagonally extending bending means across the width of said two panels which intersect at said panels adjoining edge so that when said two panels are cut they can be bent along said bending means without damaging the structural integrity of said two panels.

2. A package according to claim 1 and further comprising a means for holding said two panels in a bent position after said panels have been cut pursuant to said indicating means so that said portions of said interior surfaces can be viewed.

3. A package according to claim 2 wherein said two adjoining panels form a corner and wherein said means for holding said two panels comprises a clip including:

a bent portion having two arm portions which fit in the inside of said corner of said two adjoining panels, two straight portions extending perpendicuarly from equally spaced opposite positions on said arms of said bent portion, and means extending perpendicularly from each of said straight portions in the same direction and parallel to said arm portions of said bent portion to hold said adjoining panels so that said portion of the interior surface of said panels can be viewed.

4. A package according to claims 1 or 2 and further comprising marketing indicia on said portions of said interior surfaces of said two panels.

5. A package according to claims 1 or 2 wherein said indicating means are on the package.

6. A package according to claims 1 or 2 wherein said bending means are score marks on the package.

* * * * *

UNITED STATES PATENT AND TRADEMARK OFFICE

CERTIFICATE OF CORRECTION

PATENT NO. : 4,408,689

DATED : October 11, 1983

INVENTOR(S) : Joseph C. Daniels

It is certified that error appears in the above—identified patent and that said Letters Patent is hereby corrected as shown below:

Column 1, Line 10, After "such" and before "a", insert ---as---

Column 2, Line 32, After "the" first occurrence, delete "pacakge" and substitute therefor ---package---

Before "at" delete "preferable" and substitute therefor ---preferably---

Line 34, After "to" and before "point", insert ---a---

After "package," delete "preferable" and substitute therefor ---preferably---

Column 3, Line 2, After "60." and before "perpendicularly" delete "Exending" and substitute therefor ---Extending---

Line 22, Claim 1, After "two" and before "said" delete "to" and substitute therefor ---of---

UNITED STATES PATENT AND TRADEMARK OFFICE

CERTIFICATE OF CORRECTION

PATENT NO. : 4,408,689

DATED : October 11, 1983

INVENTOR(S) : Joseph C. Daniels

It is certified that error appears in the above—identified patent and that said Letters Patent is hereby corrected as shown below:

Column 4, Line 14, Claim 3, After "extending" and before "from" delete "perpendicuarly" and substitute therefor ---perpendicularly---

Signed and Sealed this

*Twenty-fourth* Day of *January 1984*

[SEAL]

*Attest:*

GERALD J. MOSSINGHOFF

*Attesting Officer*

*Commissioner of Patents and Trademarks*